US007904968B2

(12) United States Patent
Fletcher

(10) Patent No.: US 7,904,968 B2
(45) Date of Patent: Mar. 15, 2011

(54) APRON WITH A BENDABLE POCKET-FORMING DEVICE

(76) Inventor: Darci Fletcher, Reno, NV (US)

( * ) Notice: Subject to any disclaimer, the term of this patent is extended or adjusted under 35 U.S.C. 154(b) by 0 days.

(21) Appl. No.: 12/509,348

(22) Filed: Jul. 24, 2009

(65) Prior Publication Data

US 2011/0016598 A1 Jan. 27, 2011

(51) Int. Cl.
*A41D 13/04* (2006.01)

(52) U.S. Cl. ..... 2/48; 2/49.2

(58) Field of Classification Search ..... 2/48, 49.2, 2/49.1, 49.3–49.5, 51, 52, 50, 247, 248–251, 2/253, 254, 217, 215, 216, 223, 255, 256, 2/259, 260, 264, 258
See application file for complete search history.

(56) References Cited

U.S. PATENT DOCUMENTS

| | | | | | |
|---|---|---|---|---|---|
| 4,584 | A | * | 6/1846 | Hough | 2/216 |
| 56,146 | A | * | 7/1866 | McFarland | 2/216 |
| 63,865 | A | * | 4/1867 | Day | 2/216 |
| RE8,378 | E | * | 8/1878 | DeForest et al. | 2/216 |
| 357,370 | A | * | 2/1887 | Cohn | 2/215 |
| 358,367 | A | | 2/1887 | Spies | |
| 453,490 | A | | 6/1891 | Kropp | |
| 581,884 | A | * | 5/1897 | Gourley | 2/312 |
| 590,991 | A | * | 10/1897 | Lenhart | 2/49.2 |
| 615,293 | A | | 12/1898 | Maier | |
| 677,010 | A | | 6/1901 | Ziller | |
| 851,107 | A | * | 4/1907 | Rink | 24/8 |
| 996,084 | A | * | 6/1911 | Herring | 2/49.2 |
| 1,592,283 | A | * | 7/1926 | Mckenzie | 2/48 |
| 1,614,607 | A | * | 1/1927 | Ewen | 24/3.5 |
| 1,837,848 | A | * | 12/1931 | Brothers | 2/50 |
| 1,943,728 | A | * | 1/1934 | Fulton | 132/156 |
| 2,265,690 | A | | 12/1941 | Fiedler | |
| 2,517,357 | A | * | 8/1950 | Schlegel, Jr. | 2/49.2 |
| 2,592,087 | A | * | 4/1952 | Wallace | 224/677 |
| 2,672,614 | A | | 4/1952 | Zimmerman et al. | |
| 2,619,649 | A | * | 12/1952 | Brown | 2/52 |
| 2,789,289 | A | * | 4/1957 | Stevens et al. | 2/52 |
| 3,010,111 | A | * | 11/1961 | Ralph | 2/49.3 |
| 3,407,407 | A | | 10/1968 | Hollander et al. | |
| 3,952,332 | A | | 4/1976 | Tanner | |
| 4,114,199 | A | | 9/1978 | Malan | |
| 4,301,544 | A | | 11/1981 | Burton | |
| 4,441,212 | A | | 4/1984 | Ahr et al. | |
| 4,445,231 | A | | 5/1984 | Noel | |
| 4,569,086 | A | | 2/1986 | Takefman | |
| 4,862,518 | A | * | 9/1989 | Williams et al. | 2/49.1 |
| 5,036,547 | A | | 8/1991 | Silas | |

(Continued)

FOREIGN PATENT DOCUMENTS

JP 09003704 A * 1/1997

*Primary Examiner* — Amy B Vanatta
(74) *Attorney, Agent, or Firm* — Knobbe Martens Olson & Bear LLP

(57) ABSTRACT

The present invention relates generally to an apron or bib, and in particular, to a pocket-forming device that bends to form a pocket in an apron for catching and holding material. The pocket-forming device comprises an elongated base with a plurality of elongated members extending away therefrom. The elongated members have ends connected to the base at different positions along the base's length, and at least one of the elongated members can be configured to be bent to cause the portion of the apron to form a pocket for catching debris.

17 Claims, 10 Drawing Sheets

U.S. PATENT DOCUMENTS

| | | | | |
|---|---|---|---|---|
| 5,107,545 | A | 4/1992 | Potter | |
| 5,181,275 | A | 1/1993 | Spulgis | |
| 5,220,692 | A | 6/1993 | Cox | |
| 5,504,941 | A | 4/1996 | Sell | |
| 5,530,968 | A | 7/1996 | Crockett | |
| 5,918,311 | A | 7/1999 | Lampson et al. | |
| 6,058,506 | A | 5/2000 | Reinhart, Jr. | |
| 6,105,165 | A | 8/2000 | Johnson et al. | |
| 6,128,780 | A | 10/2000 | Reinhart et al. | |
| 6,481,016 | B1 | 11/2002 | Rees | |
| 6,490,731 | B1 | 12/2002 | Hyatt | |
| 6,708,341 | B1 | 3/2004 | Schaller | |
| 6,732,375 | B2 * | 5/2004 | Nornes | 2/49.1 |
| 7,143,448 | B1 | 12/2006 | Gottehrer | |
| 7,260,851 | B1 | 8/2007 | Milnark et al. | |
| 7,269,857 | B2 | 9/2007 | Cymbol | |
| 7,380,284 | B1 | 6/2008 | Dodani | |
| 7,418,739 | B2 | 9/2008 | Chan | |
| 2001/0054191 | A1 | 12/2001 | Frye | |
| 2007/0277293 | A1 * | 12/2007 | Koepp | 2/256 |

* cited by examiner

APRON WITH A BENDABLE POCKET-FORMING DEVICE

BACKGROUND

1. Field of the Invention

The present invention relates generally to an apron or bib, and in particular, to a pocket-forming device that bends to form a pocket in an apron for catching and holding material.

2. Description of the Related Art

Many types of bibs and aprons, and even some with pockets or basins for catching and holding material, are known in the art. However, it is difficult to design an apron or bib with a simple pocket-forming device with the flexibility to be shaped to a user's preference while providing ease of cleaning and replacement.

A number of aprons or bibs with various types of devices for forming pockets therein have been developed. Some of these conventional aprons have been designed with complex, adjustable wire frames and other structures to form the apron pocket. In other designs, stiffening elements have been used that are permanently affixed to a portion of an apron or bib to form a pocket therein. In other conventional designs, a stiffening element may be designed that is not permanently affixed to the apron, but has a permanent, inflexible shape. In another conventional design, a stiffening frame unit has been used that includes strips extending away from a single, central hub. These designs are all complex or difficult to use, or limit the apron user to a specific, permanent pocket shape or design. Any designs that have attempted to overcome these obstacles, by allowing the user some control over the shape of the pocket in the apron, have limited flexibility in the pocket shape.

SUMMARY

One embodiment provides an apron pocket-forming device comprising an elongated base and a plurality of elongated members extending away from the base. The plurality of elongated members has ends connected to the base at different positions along a length of the base. At least one of the elongated members is configured to be bent about an axis generally parallel to a portion of the base. The device is adapted to reside approximately adjacent to a portion of an apron such that the elongated members can be bent to cause the portion of the apron to form a pocket for catching debris.

Another embodiment provides an apron comprising a garment adapted to be worn as an apron, a portion of the garment including a pouch adapted to receive a device. The device is adapted to be received within the pouch of the garment. The device comprises an elongated base and a plurality of elongated members extending away from the base. The plurality of elongated members has ends connected to the base at different positions along a length of the base. At least one of the elongated members is configured to be bent about an axis substantially parallel to a portion of the base. The device is adapted to reside within the pouch, and the elongated members can be bent to cause the lower portion of the garment to form a pocket for catching debris.

Another embodiment provides an apron comprising a garment adapted to be worn as an apron, a portion of the garment including a pouch adapted to receive a device. The device is adapted to be received within the pouch of the garment. The device comprises at least three elongated members spaced apart from each other across a portion of a width of the apron. At least one of the elongated members is configured to be bent about an axis extending substantially across the width of the apron. The device is adapted to reside within the pouch, and the elongated members can be bent to cause the portion of the garment to form a pocket for catching debris.

Another embodiment provides an apron comprising a garment adapted to be worn as an apron. The device is adapted to be held adjacent to the garment. The device comprises at least three elongated members spaced apart from each other across a portion of a width of the garment. At least one of the elongated members is configured to be bent about an axis extending substantially across the width of the garment. The elongated members can be bent to cause a portion of the garment to form a pocket for catching debris.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other aspects of the invention will be readily apparent from the following description and from the appended drawings (not to scale), which are meant to illustrate and not to limit the invention, and in which.

DETAILED DESCRIPTION OF THE PREFERRED EMBODIMENTS

Many pocket-forming devices with various structures for forming pockets or basins in aprons or bibs are known in the art. However, many conventional apron pocket-forming devices have been designed to be permanently affixed to the apron garment, or have been designed with a single, limited, permanent shape. Other apron pocket-forming devices are removable from the apron garment, but have complex structures which make removal or replacement difficult. Some conventional apron pocket-forming devices provide some control over the pocket shape, but are limited to certain planes or axes. Embodiments of the present invention provide a simple, effective device that can be bent about many different axes to form a pocket in an apron of many different shapes. Some embodiments provide a pocket-forming device that can be removed from an apron for ease of cleaning and/or replacement.

Figure 1A:
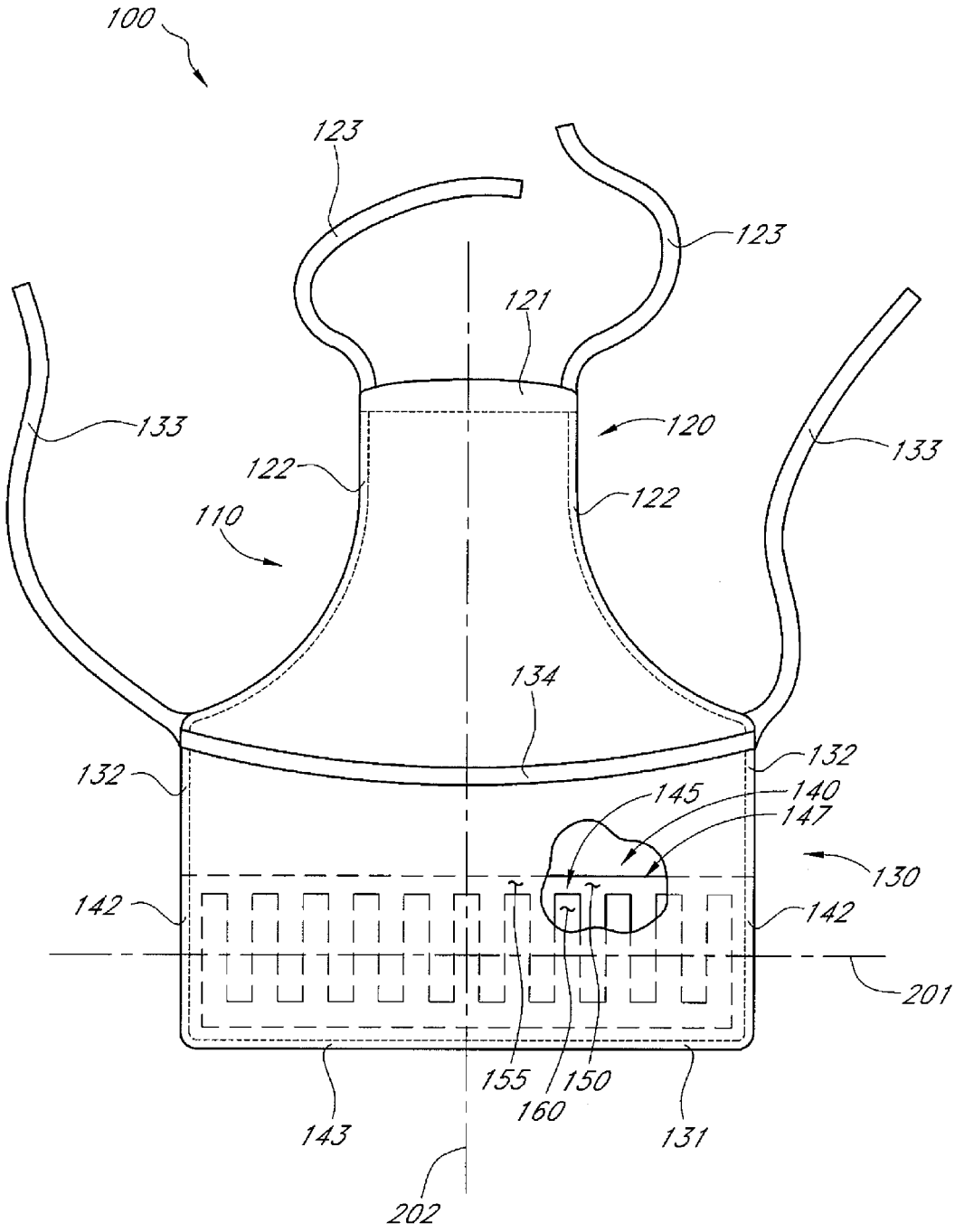
FIGS. 1A and 1B are a front and back schematic view, respectively, of a bib, or apron adapted to receive a pocket-forming device.
Figure 1B:
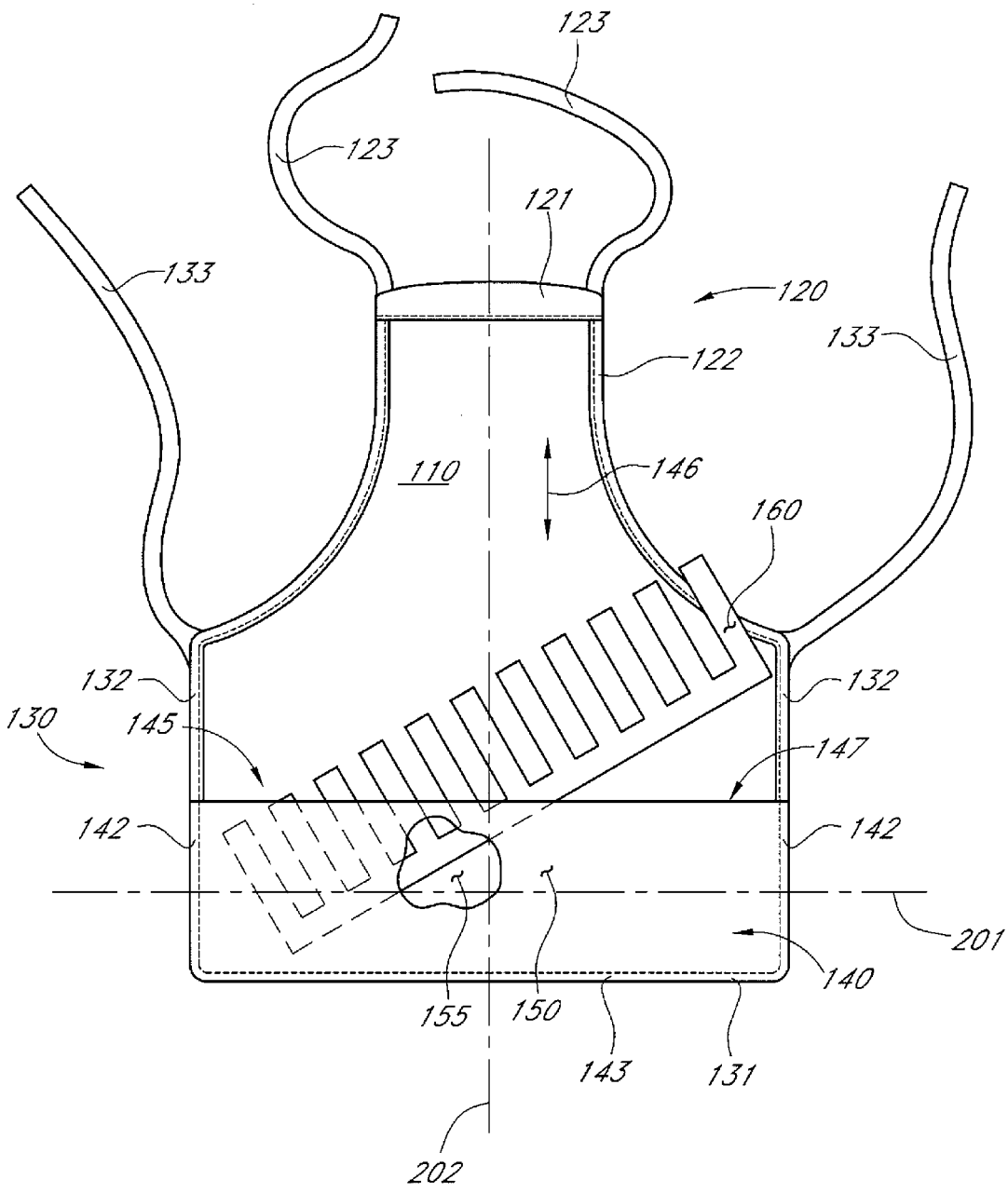
Figure 2:
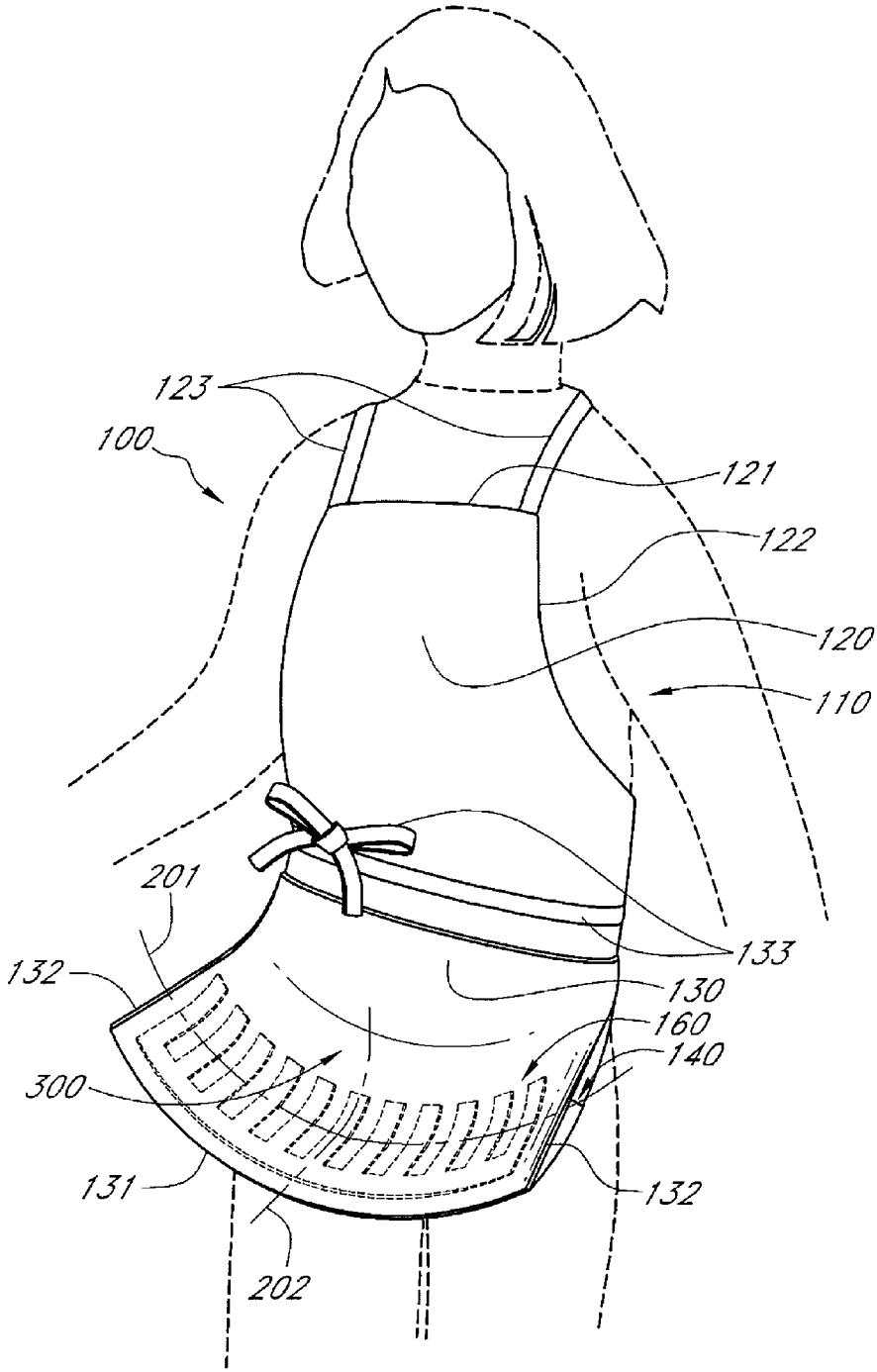
FIG. 2 is a side isometric view of a user wearing an apron with a pocket-forming device.

FIGS. 1A and 1B illustrate a front and back view, respectively, of a bib, or apron 100 adapted to receive a pocket-forming device 160. FIG. 2 illustrates a side isometric view of a user wearing an apron 100. Referring to FIGS. 1A-2, apron 100 can comprise a garment that forms a body 110 sized and shaped to partially cover a user's body, as is known in the art of aprons and bibs. In some embodiments, body 110 can comprise a pouch 140, which is sized and shaped to receive a pocket-forming device 160. Device 160, as described further herein, can bend to form a pocket 300 in the apron 100 (FIG. 2).

Referring to FIGS. 1A-2, body 110 can comprise one or more layers of a variety of durable and flexible materials, as is known in the art, such as denim, canvas, oil cloth, leather, cotton, nylon, vinyl, and the like. In a preferred embodiment, at least a portion of body 110 comprises canvas. Each layer of material in body 110 can comprise one or more of these materials, such as a laminate, composite, or coated material. In an embodiment, at least a portion of body 110 comprises a waterproof material. In a preferred embodiment, at least a portion of body 110 comprises vinyl. Body 110 can comprise many different sizes and shapes, such as a larger, approximately rectangular shape to accommodate an adult (as in a mechanic's apron), or a smaller, substantially oblong shape (as in a bib for a child). In some embodiments, body 110 can comprise an upper section 120 and lower section 130, as will be described presently.

Upper section 120 can be sized to cover, and in some embodiments, wrap at least partially around, the torso, or upper torso, of the user of apron 100, as is known in the art. Upper section 120 can comprise a top edge 121 and upper side edges 122. Upper side edges 122 can be substantially straight, or, as illustrated in the exemplary embodiment, tapered, to provide a better fit for the arms of a user, as is known. Top edge 121 can be curved, to conform to the shape of a user's neck, or it can be substantially straight, as shown in the exemplary embodiment of FIGS. 1A-1B. Upper section 120 can comprise a pair of straps 123 configured to adjustably hold apron 100 around a user's neck, such as by tying straps 123 together. Straps 123 can be positioned along top edge 121 or an upper portion of upper side edges 122. A skilled artisan will understand that apron 100 can be held around a user's neck in many different ways, and can be adjustable to fit many different users. Straps 123 can comprise any of the materials described above for body 110, or may comprise other known strap materials, such as rope, elastic, webbing material, and the like. In some embodiments, straps 123 can be configured to adjustably hold apron 100 around a user's neck with buckles, snaps, zippers, clasps, hook/loops (ie Velcro™), and any other mechanical fastening and adjustment device known in the art. In some embodiments, apron 100 can comprise a single, continuous strap (not shown) to form a loop to hold apron 100 around a user's neck.

Lower section 130 can be sized and shaped in any way to cover, and in some embodiments, wrap at least partially around, a lower portion of a user's body, such as the lower torso, or a portion of a user's waist or legs. Lower section 130 can comprise a bottom edge 131 and lower side edges 132 positioned between bottom edge 131 and upper side edges 122. Edges 131, 132 can be curved, or as shown in the illustrated exemplary embodiment, substantially straight. Lower section 130 can comprise straps 133 configured to hold apron 100 around a user's torso, such as by tying straps 133 around the user's waist. Straps 133 can comprise any of the materials described above for straps 123, and can function similarly to the manner thereof, to adjustably hold lower section 130 to a lower portion of a user's body.

Upper section 120 and lower section 130 can comprise any of the materials described above for body 110, and can comprise the same or different materials relative to each other. In some embodiments, one of sections 120, 130 comprises a material that absorbs fluid, whereas the other of sections 120, 130 comprises a material that repels, or is resistant to absorbing fluid. In some embodiments, sections 120, 130 comprise a single integrated piece. In a preferred embodiment, sections 120, 130 comprise separate pieces. In a further preferred embodiment, sections 120, 130 can comprise a common edge 134 with mechanical fasteners (not shown) so that sections 120, 130 can be connected to and disconnected from each other, allowing sections 120, 130 to be cleaned separately from each other.

In some embodiments, upper section 120 and/or lower section 130 can comprise a pouch 140, which can be adapted to receive the pocket-forming device 160. Pouch 140 can be integrated with lower section 130, as illustrated in FIGS. 1A-2, or in some embodiments, integrated with upper section 120. In other embodiments, pouch 140 can be separate from lower sections 120, 130 (see FIG. 7), and can be positioned on or adjacent to section 120 and/or section 130 to form a pocket in apron 100. Pouch 140 can comprise any of the materials described above for upper and/or lower sections 120, 130, and can comprise the same or different materials as upper and/or lower sections 120, 130. Pouch 140 can be adapted to receive the pocket-forming device 160 in many different ways.

Referring to FIGS. 1A-1B, pouch 140 can comprise a first layer of material 155, forming a front side to the pouch, and an adjacent second layer of material 150, forming a back side to the pouch, with an inner volume therebetween for receiving device 160. FIGS. 1A-1B show a portion of layer 155 and layer 150, respectively, cutaway for clarity. The inner volume of pouch 140 between layers 150, 155 can be bounded by two side pouch edges 142, a bottom pouch edge 143, and an upper pouch edge 147. First layer 155 and second layer 150 can be attached at edges 142, 143, and/or 147 to hold device 160 within pouch 140. In some embodiments, layers 150, 155 can be pleated and/or can include varying amounts of material such that pouch 140 can form a variety of shapes and sizes. Layers 150, 155 can be attached at edges 142, 143 and/or 147 in many different ways known in the art, such as with stitching, adhesive, staples, rivets, or the like. In some embodiments, layers 150, 155 can be removably attached and detached at edges 142, 143 and/or 147 with removable mechanical fasteners, such as buttons, ties, zippers, snaps, Velcro™, etc. In some embodiments, layers 155, 150 can be detached from each other at one or more of edges 142, 143 and/or 147, to form one or more openings in pouch 140. In a preferred embodiment, layers 155, 150 can be detached along upper pouch edge 147 to form an opening 145, providing access to the inner volume of pouch 140. Opening 145 can be configured so that device 160 can be inserted into and removed from pouch 140. In this way, pouch 140 can removably and repeatedly receive device 160. Device 160 can be repeatedly and removably received by pouch 140 to allow apron 100 and device 160 to be separately cleaned and/or replaced, or to exchange device 160 with another pocket-forming device of desired characteristics. FIG. 1B illustrates a condition wherein device 160 is partially removed from an embodiment of a pouch 140, and the movement of device 160 to and from pouch 140 through opening 145 is shown by direction arrows 146.

A skilled artisan will understand that the configuration of pouch 140 illustrated in FIGS. 1A-1B is for exemplary purposes only, and that pouch 140 can be configured in many different ways. In the illustrated embodiment, the first material layer 155 of pouch 140 is common with lower section 130. As such, pouch 140 can be integrated with lower section 130. In some embodiments, the first material layer 155, and pouch 140 can be separate from lower section 130 (see, e.g., FIG. 7). As such, pouch 140 can be integrated with apron 100, or can be separate from apron 100, such as in a removable pouch 140.

Referring again to FIGS. 1A and 1B, the edges 142, 143 of pouch 140 are positioned approximately adjacent and substantially parallel to edges 132, 131, respectively, such that device 160 is positioned approximately horizontally across the width of apron 100 along a lower portion of lower section 130. In some embodiments, edges 142, 143 can be positioned at a lower, middle or upper portion of either upper or lower sections 120, 130, and can be positioned at many angles relative to edges 131, 132. In some embodiments, a plurality of pouches 140 can be configured in upper and/or lower sections 120, 130, to receive a plurality of pocket forming devices 160, to form a plurality of pockets in apron 100.

Pouch 140 can be adapted to be accessed from different sides of apron 100. In the exemplary illustrated embodiment, second material layer 150 is positioned on the back of apron 100, such that the opening 145 to pouch 140 is formed on the back of apron 100. In such an embodiment, the insertion and removal of device 160 to and from pouch 140 is accessible from the back of apron 100. In other embodiments, second material layer 150 can be positioned on the front of apron 100, such that the opening 145 of pouch 140 is formed on the front of apron 100. In such an embodiment, the insertion and removal of device 160 to and from pouch 140 can be accessible from the front of apron 100.

Pouch 140 can be adapted to be accessed in many different directions. In the exemplary illustrated embodiment, opening 145 is configured to be formed along the upper pouch edge 147 of pouch 140, to provide top, or upper, access to pouch 140. In some embodiments, opening 145 can be configured along side edges 142, or lower edge 143, to provide side, or lower access, respectively, to pouch 140. In some embodiments, more than one opening 145 can be formed in pouch 140, to provide access to pouch 140 from more than one direction.

Referring to FIG. 2, pocket-forming device 160 can form a pocket in apron 100 when device 160 resides approximately adjacent to a portion of apron 100. Device 160 can reside approximately adjacent to apron 100 when an embodiment of a pouch as described herein receives device 160 and the pouch positioned adjacent to apron 100. In other embodiments, device 160 can be held adjacent to a portion of apron 100 by forming a hem around device 160. A hem can be formed around device 160 when layers 150, 155 are attached as described above, such as with stitching or adhesive, around each of edges 142, 143 and 147. In another embodiment, layers 150, 155 are attached with a hem that follows the outer perimeter of pocket-forming device 160. A hem around device 160 can decrease the movement of device 160 in pouch 140, and can provide a user with increased control over the shape of the pouch formed by device 160.

Device 160 can reside approximately adjacent to apron 100 by directly attaching device 160 to apron 100, such as with adhesive, stitching, or mechanical fasteners. In some embodiments, device 160 can be attached to an outer layer of apron 100, or can be attached directly between layers of apron 100. In another embodiment, device 160 can be attached to an inner portion of pouch 140 with mechanical fasteners, adhesive and the like.

Figure 3:
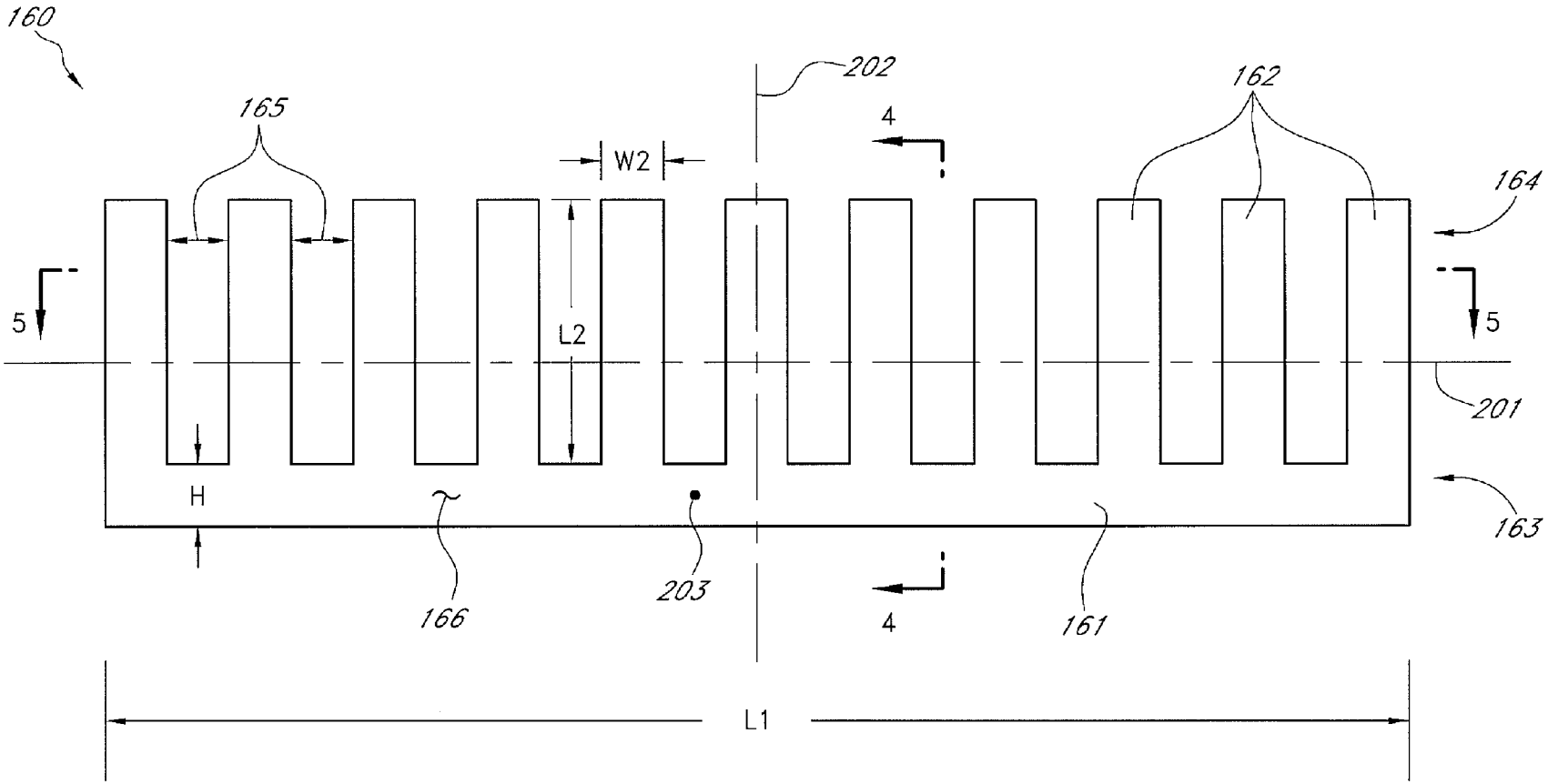
FIG. 3 is a front schematic view of a pocket-forming device.

FIG. 3 illustrates a front view of the pocket-forming device 160, in a flat, or unbent state. Pocket forming device 160 can comprise an elongated base 161 with a plurality of elongated members 162 connected to the base 161 at different positions along the length of base 161, and extending away from base 161. As such, pocket forming device 160 can comprise a substantially comb-like shape. The size, shape, materials, and configuration of pocket forming device 160 can be varied to tune the desired shape and characteristics of the pocket 300 formed in apron 100.

Elongated base 161 can comprise any of many different shapes, such as a curved, rectangular arc, or an oblong ellipse. Elongated base 161 can comprise a cylindrical, elliptical, or rectangular rod. In a preferred embodiment, base 161 comprises a rectangular strip of length L1, height H, and width W1 (see also FIGS. 4-5).

Base 161 can be configured to have many different lengths L1. In some embodiments, base 161 can have a length L1 such that base 161 can bend to form a pocket shape, and in a preferred embodiment, a stable pocket shape, as described further below. In certain embodiments, the length L1 of base 161 can range from approximately 4 inches to 30 inches, or more narrowly, from approximately 6 inches to 24 inches, or even more narrowly, from approximately 12 to 18 inches. Length L1, height H and width W1 can be selected, along with the material of base 161, such that pocket forming device 160 can bend to form a pocket in apron 100 and can be received by pouch 140.

Elongated base 161 can comprise any of a variety of different materials, such as plastic or metal. Elongated base 161 can comprise more than one material, such as a composite, or a metal coated with rubber or plastic. Elongated base 161 can comprise a material that has been thermally, chemically or mechanically treated to provide increased durability, flexibility, and/or chemical resistance of elongated base 161. Elongated base can comprise stainless steel. Elongated base 161 can comprise any material with sufficient flexibility to bend and form a pocket in apron 100, and sufficient strength and rigidity to hold any debris captured by a pocket that has been formed in apron 100, and to repeatedly move between a bent and unbent position. Elongated base 161 can comprise sheet metal, wire, or spring steel. In a preferred embodiment, elongated base 161 can comprise a material that is stable when bent, such that pocket forming device 160 forms a pocket in apron 100 with a stable shape.

A plurality of elongated members 162 are connected to base 161 at different positions along its length. Elongated members 162 can comprise any of the materials described above for elongated base 161, and can comprise the same or different materials relative to elongated base 161 and relative to others of the members 162. The elongated members 162 can comprise a proximal end or portion 163 connected to base 161, and a distal end or portion 164 extending away from base 161. Elongated members 162 can be connected to base 161 in many different ways, such as with welding, brazing, or can be configured to mechanically fasten to base 161 such as with fasteners, or with clamps or tabs that extend around base 161 (not shown). Elongated members 162 can be removable from base 161, such as by removing clamps or fasteners, to allow elongated members 162 to be replaced with another member 162. In some embodiments, members 162 can be exchanged for different elongated members 162 with different sizes or physical properties. In a preferred embodiment, elongated members 162 and base 161 comprise a single, integrally formed piece.

Elongated members 162 can be connected to and positioned along base 161 in many configurations. Elongated members 162 can be positioned approximately adjacent (e.g., directly adjacent) to each other, and connected to base 161 at different positions along the length of base 161, with gaps 165 therebetween. Elongated members 162 can be spaced evenly along the length of base 161, such that the gaps 165 are approximately equal to one another, or can be differently spaced along the length of base 161, such that the gaps 165 vary. In some embodiments, gaps 165 can be varied relative to each other along the length of base 161, such that device 160 will form a desired shape when members 162 and/or base 161 are bent to form a pocket in apron 100.

At least the proximal ends 163 of elongated members 162 can be configured to extend away from base 161 at an angle relative to base 161, and can be configured in the same plane, or in different planes. In a preferred embodiment, each of members 162 extend away from base 161 at approximately the same angle. In another preferred embodiment, each of members 162 are configured in approximately the same plane. In a further preferred embodiment, each of members 162 extends approximately orthogonally away from base 161. In other embodiments, members 162 can extend away from base 161 at substantially different angles relative to each other and/or base 161 (see, e.g., FIG. 8B). The angle of members 162 relative to each other and/or to base 161 can be varied such that device 160 will form a desired pocket shape when members 162 and/or base 161 are bent to form a pocket in apron 100.

Figure 4:
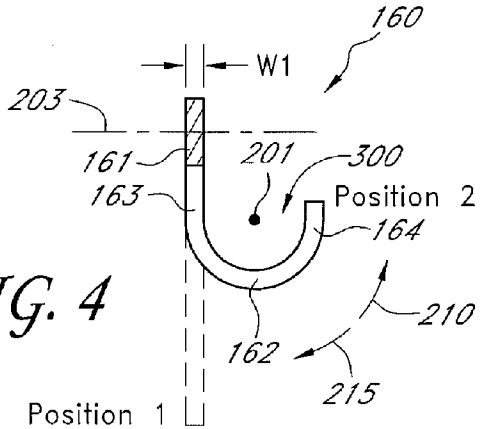
FIG. 4 is a cross-sectional side schematic view of the pocket-forming device of FIG. 3 in an unbent position and a bent position about a first axis.
Figure 5:
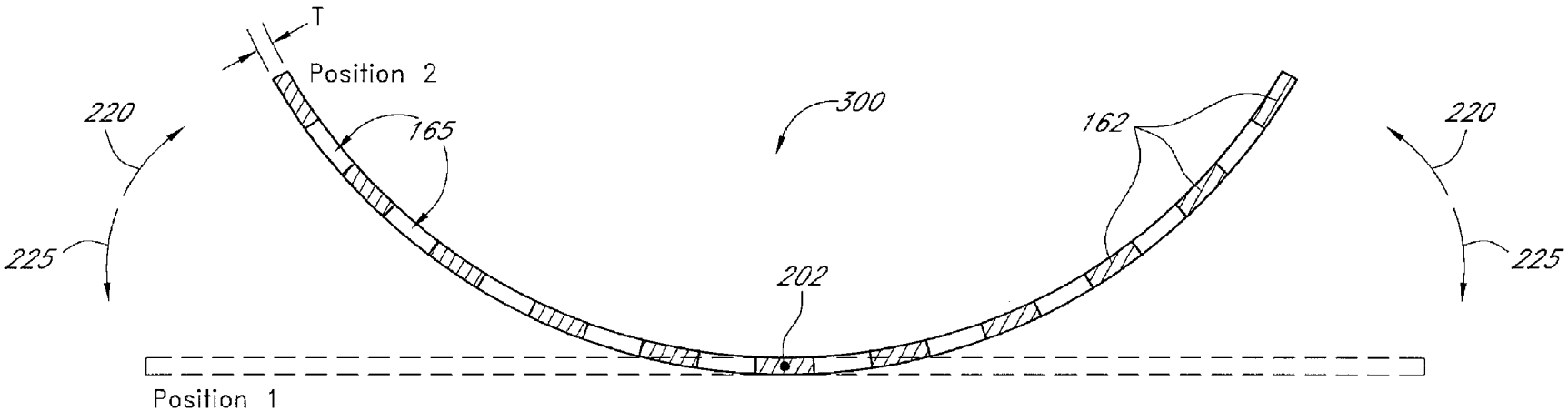
FIG. 5 is a cross-sectional side schematic view of the pocket-forming device of FIG. 3 in an unbent position and a bent position about a second axis.

Elongated members 162 can comprise any of a variety of shapes and sizes, such as a curved, rectangular arc, or an oblong ellipse. Each of elongated members 162 can comprise the substantially the same size and/or shape relative to each other, or can comprise substantially different sizes and/or shapes relative to each other. Elongated members 162 can comprise, for example and without limitation, a cylindrical, elliptical, or rectangular rod. Referring to FIGS. 3-5, a member 162 can comprise a rectangular strip of length L2, thickness T, and width W2.

Elongated members 162 can be configured to be many different lengths L2. In some embodiments, members 162 can have a length L2 such that members 162 can bend to form a stable pocket shape, as described further below. In certain embodiments, the length L2 of members 162 ranges from approximately 1 inch to 18 inches, or more narrowly, from approximately 2 inches to 12 inches, or even more narrowly, from approximately 3 inches to 6 inches. In some embodiments, elongated members 162 comprise approximately the same length L2. In other embodiments, the length of elongated members 162 vary relative to each other, such that the elongated members 162 form a profile 400 along the distal ends thereof (see, e.g., FIGS. 8B, 8C). Elongated members 162 can form a profile 400 so that device 160 will form a desired pocket shape when members 162 and/or base 161 are bent to form a pocket in apron 100. Length L2, thickness T, and width W2 can be selected, along with the material of elongated members 161, such that pocket forming device 160 can bend to form a pocket in apron 100 and can be received by pouch 140.

Elongated members 162 can be configured to be many different widths W2. In some embodiments, members 162 can have a width W2 such that members 162 can bend to form a pocket shape, and in a preferred embodiment, a stable pocket shape, as described further below. In certain embodiments, the width W2 of members 162 ranges from approximately 0.1 inches to 6 inches, or more narrowly, from approximately 0.25 inches to 4 inches, or even more narrowly, from approximately 0.5 inches to 2.5 inches. In some embodiments, elongated members 162 comprise approximately the same width W2. In other embodiments, the width W2 of elongated members 162 can be varied relative to each other so that device 160 will form a desired pocket shape when members 162 and/or base 161 are bent to form a pocket in apron 100. Length L2, thickness T, and width W2 can be selected, along with the material of elongated members 161, such that pocket forming device 160 can bend to form a pocket in apron 100 and can be received by pouch 140. In some embodiments, thickness T of elongated members 162 and width W1 of base 161 can be approximately the same, and in other embodiments, thickness T and width W1 can be approximately different.

Pocket-forming device 160 can comprise many different numbers of elongated members 162 extending from base 161. The number of elongated members 162 can be varied, depending on, e.g., the size and shape of members 162, the length of base 161, the size of pouch 140, and the desired shape of the pocket formed in apron 100. In an embodiment, the width W2 of elongated members 162 can be selected to increase the number of elongated members 162 along a base 161 of a given length L1. Increasing the number of elongated members 162 can provide increased control over the shape of the pocket formed in apron 100. In certain embodiments, device 160 comprises a range of 3-90 elongated members 162, or more narrowly, a range of 3-60 elongated members 162, or even more narrowly, a range of 4-30 elongated members 162, or even more narrowly, a range of 5-15 elongated members 162. In a further preferred embodiment, device 160 comprises 11 elongated members 162.

FIG. 4 illustrates a cross-sectional side view, taken along line 4-4 of FIG. 3, of device 160 in an unbent position (shown in phantom lines, "POSITION 1") and a bent position (shown in solid lines, "POSITION 2"). A skilled artisan will understand that although device 160 is shown herein as being "flat" in the unbent position, "unbent" does not necessarily mean "flat". For example, in some embodiments described above, the elongated base 161 and members 162 can comprise a "curved" shape in an unbent state, and therefore may not be "flat" in an unbent state. Elongated members 162 can be bent around an axis 201 (FIGS. 3 and 4) to form a pocket 300 (FIG. 4). Axis 201 (FIGS. 3 and 4) can be configured in any of many different ways such that elongated members 162 can be bent therearound. For example, axis 201 can be curved, such as in embodiments where base 161 is curved, or when device 160 is configured to bend around a second axis 202, described further herein. In some embodiments, axis 201 can be generally parallel to a portion of base 161 (e.g., when base 161 is in an unbent position, or when base 161 is not bent around an axis 202 described further herein). In some embodiments, axis 201 can extend across the width of apron 100 (FIG. 1), and/or roughly parallel to a bottom edge of apron 100. In operation, a force can be applied to an elongated member 162 in the directions shown by arrow 210. In response to the force, the elongated member 162 can move, or bend, about axis 201 to a bent position, forming pocket 300. A force can be applied to elongated member 162 in the direction shown by arrow 215 to return elongated member 162 to an unbent position. In this way, elongated member 162 can be repeatedly moved between a bent and an unbent position relative to axis 201. The amount of bend in elongated members 162 can vary, either individually or collectively, to form various desired shapes of pocket 300. A skilled artisan will understand that although a single axis 201 is shown in FIG. 4, elongated members 162 can be bent about any of a plurality of axes 201 extending generally parallel to a portion of base 161.

FIG. 5 illustrates a cross-sectional side view, taken along line 5-5 of FIG. 3, of device 160 in an unbent position (shown in phantom lines, "POSITION 1") and a bent position (shown in solid lines, "POSITION 2"). The elongated base 161 can be bent around an axis 202 to form the pocket 300 (FIG. 5). Axis 202 (FIGS. 3 and 5) can be configured in many different ways such that elongated base 161 can be bent therearound. In some embodiments, axis 202 extends generally parallel to one of the elongated members 162 (e.g., when the members 162 are not bent with respect to the axis 201 described further herein). In some embodiments, axis 202 extends generally parallel to at least proximal portions 163 of elongated members 162. In some embodiments, axis 202 can extend centrally along the length of apron 100 (FIG. 1), and/or vertically, and/or roughly orthogonal to a bottom edge of apron 100. In operation, a force can be applied to elongated base 161 in the directions shown by arrow 220. In response to the force, the elongated base 161 can move, or bend, about axis 202 to a bent position, forming pocket 300. A force can be applied to elongated base 161 in the direction shown by arrow 225 to return elongated base 161 to an unbent position. In this way, elongated base 161 can be repeatedly moved between a bent and an unbent position relative to axis 202. A skilled artisan will understand that although axis 202 is shown in FIG. 5 as extending through an elongated member 162 positioned approximately in the center of elongated base 161, elongated base 161 can be bent about any of a plurality of axes 202 extending generally parallel to at least proximal portions 163 of elongated members 162. In some embodiments, elongated base 161 can be bent about a plurality of axes 202, with forces in alternating directions to form a desired shape, such as a corrugated shape, to elongated base 161 and pocket 300 (not shown).

Figure 6:
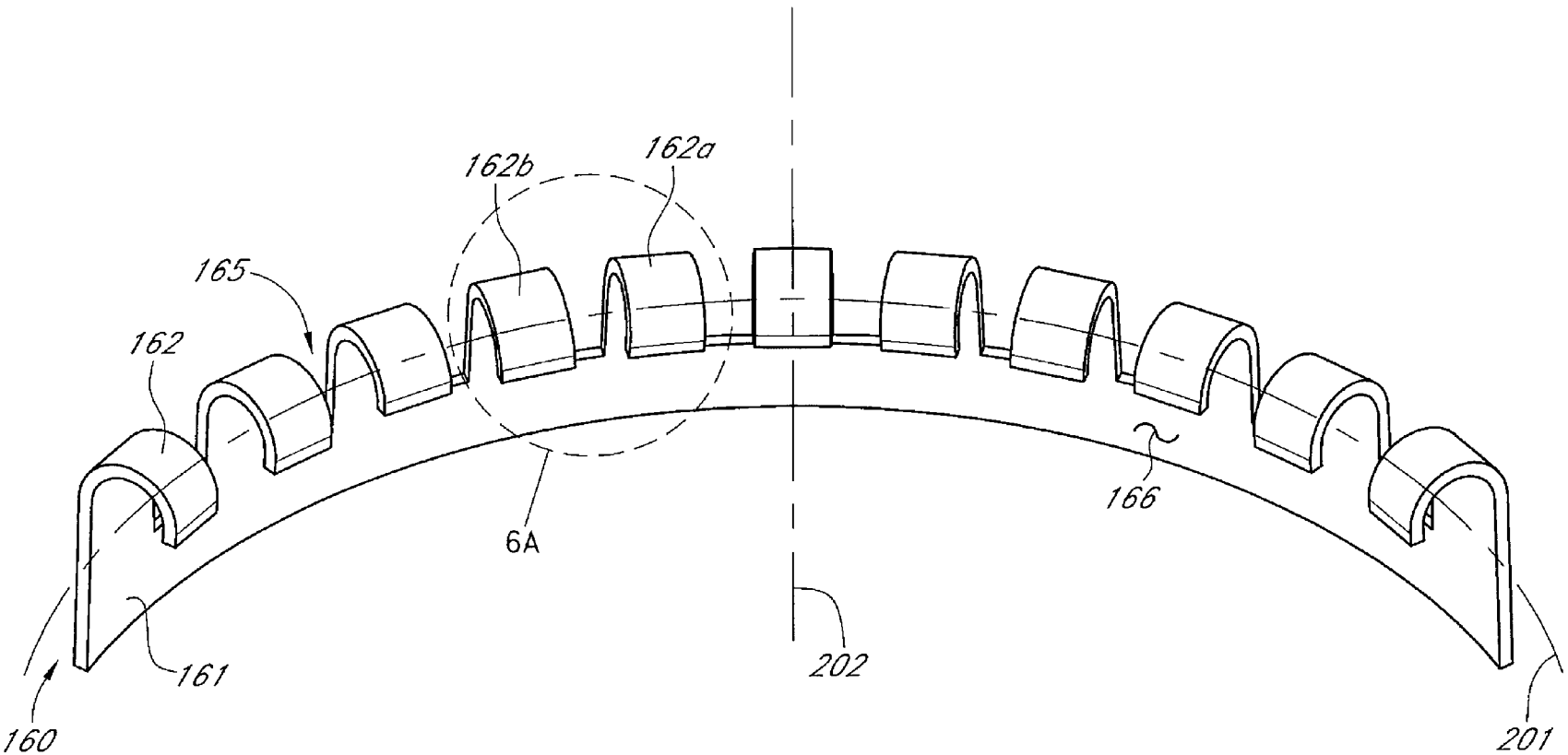
FIG. 6 is a front isometric schematic view of the pocket forming device of FIGS. 4 and 5 in a bent position.
Figure 6A:
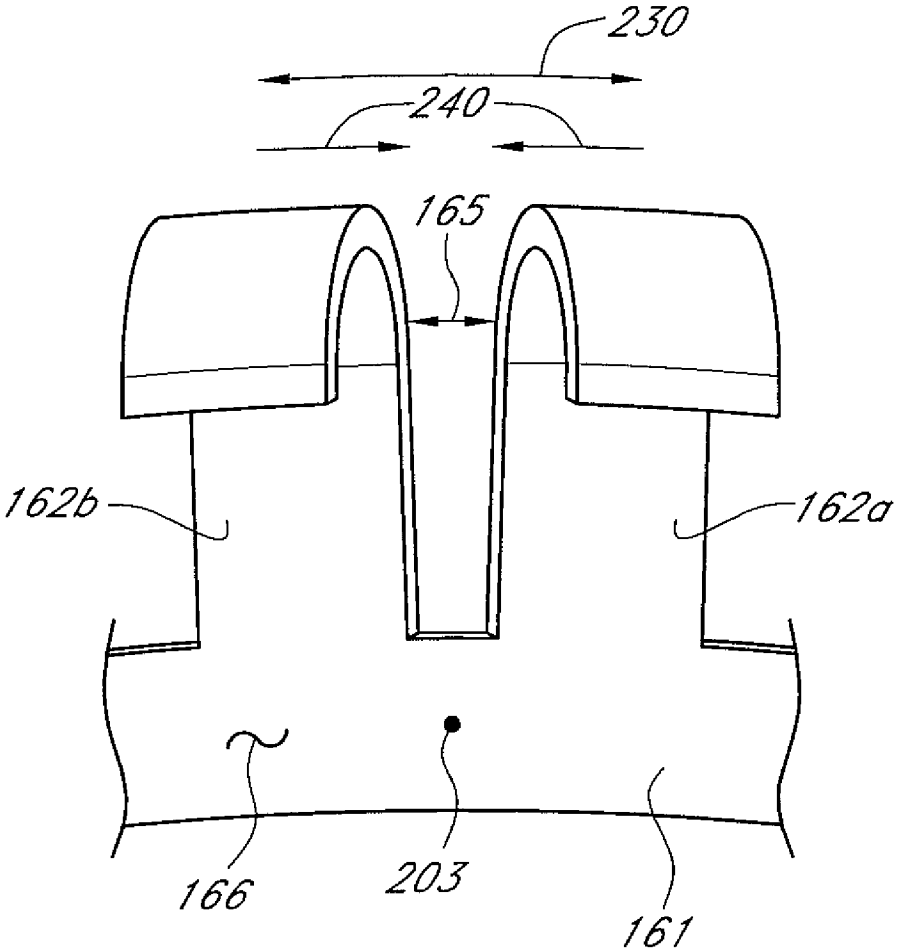
FIG. 6A is a partial schematic view of the device shown in FIG. 6.

FIG. 6 illustrates a front isometric view of device 160 in a bent position about axes 201 and 202, as described above. FIG. 6A illustrates a partial view of the device 160 shown in FIG. 6. An axis 203 (FIGS. 4, 6A) can extend between a first and second elongated member 162*a*, 162*b*, and through the width W1 of elongated base 161. Elongated members 162*a*, 162*b* comprise two elongated members 162 that are positioned approximately adjacent to each other. In a preferred embodiment, axis 203 extends approximately orthogonally to a surface 166 of elongated base 161 (FIGS. 6, 6A). In operation, a force can be applied to elongated members 162*a*, 162*b*, in the directions shown by arrows 230 (FIG. 6A). In response to the force, the elongated members 162*a*, 162*b* can move, or bend, about axis 203 to a bent position (relative to axis 203), increasing the length of gap 165 extending therebetween. A force can be applied to elongated members 162*a*, 162*b* in the direction shown by arrows 240 to return elongated members 162*a*, 162*b* to an unbent position (relative to axis 203), decreasing the length of gap 165. In this way, elongated members 162*a*, 162*b* can be repeatedly moved between a bent and an unbent position about axis 203.

Referring to FIGS. 2 and 4-6A and the embodiments described herein, a user of apron 100 can bend device 160 in many different ways to form pocket 300. In some embodiments, the base 161 and/or the elongated members 162 of device 160 can hold a stable shape after being bent. For example, base 161 and/or elongated members 162 can comprise a bendable, but inelastic material that can hold its shape memory after the material is bent, regardless of whether the forces are removed along directions 210, 215, 220, 225, 230, and/or 240 as described above (FIGS. 4, 5 and 6A). In other embodiments, the base 161 and/or the elongated members 162 of device 160 can comprise a bendable, but elastic material that will not hold its shape memory after the forces are removed along the directions 210, 215, 220, 225, 230, and/or 240. In embodiments wherein the base 161 and/or the elongated members 162 comprise a material that will not hold its shape memory after the forces are removed along the directions 210, 215, 220, 225, 230, and/or 240, apron 100 can comprise a retaining device, such as a strap or tie, extending along apron edge 131 to hold the base 161 and/or the elongated members 162 of device 160 in a stable pocket shape. As such, a retaining device can be used to hold device 160 in a stable shape after base 161 and/or elongated members 162 are bent. Pocket 300 can be used to receive, or catch material, such as kitchen or construction debris. After removing the debris from pocket 300, the user of apron 100 can move device 160 to an unbent position, as shown in FIGS. 1A-1B.

Figure 7:
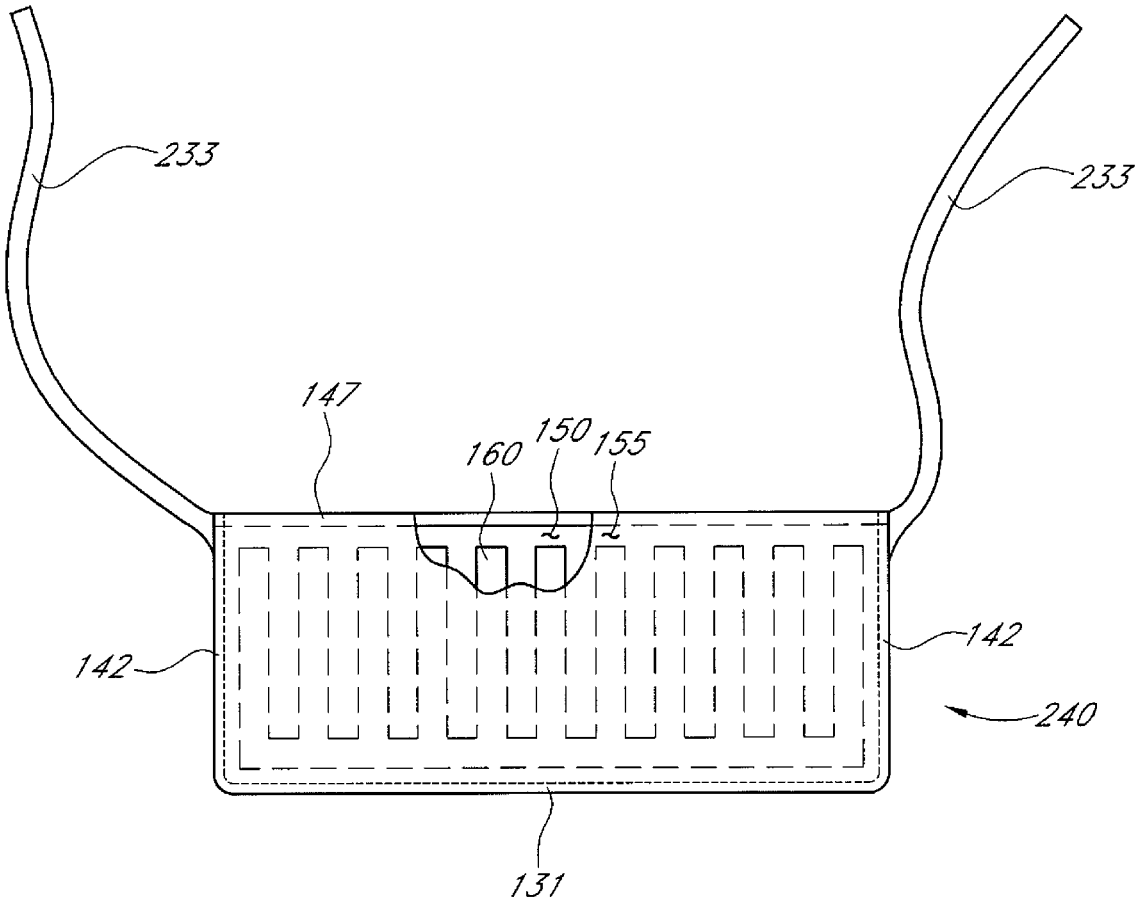
FIG. 7 is a front schematic view of a pouch.

FIG. 7 illustrates a front schematic view of a pouch 240. Components in pouch 240 that are substantially similar to components of pouch 145 shown in FIGS. 1, 2 and 7 have been given the same reference number. The main difference between this embodiment and the previous embodiments is that the layer of material 150 is a layer of material separate from apron 100. Thus, pouch 240 can be used separately to form a pocket for catching debris, without requiring a body 110 or the remaining components of apron 100 shown in FIGS. 1, 2 and 7. In some embodiments, pouch 240 can be used adjacent to or as an overlay/underlay to a conventional apron, to form a pocket therein, while still allowing pouch 240 to be washed separately. In some embodiments, pouch 240 can comprise mechanical fasteners to hold pouch 240 adjacent to a conventional apron. In some embodiments, pouch 240 can comprise optional straps 233 to hold pouch 240 to a conventional apron and/or a user thereof. In other embodiments, pouch 240 can be used as a standalone apron, wherein straps 233 hold pouch 240 partially around a user, and a pocket is formed within pouch 240 itself.

Figure 8B:
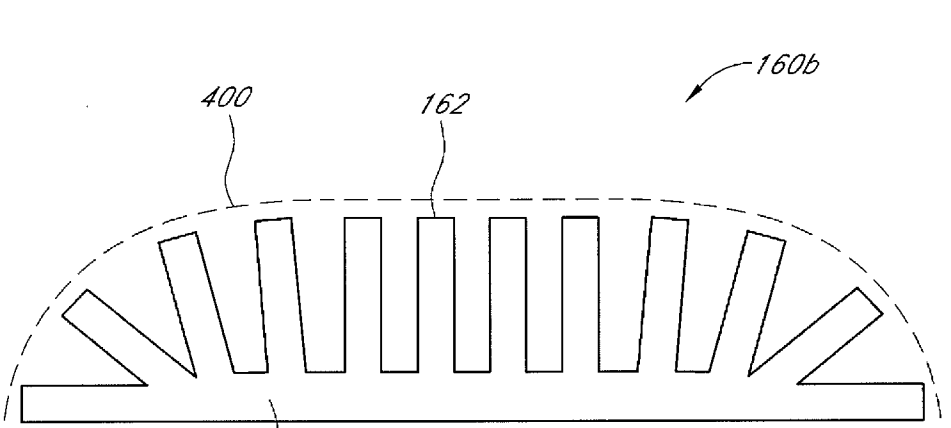
FIGS. 8A-8C illustrate various embodiments of a pocket forming device.
Figure 8C:
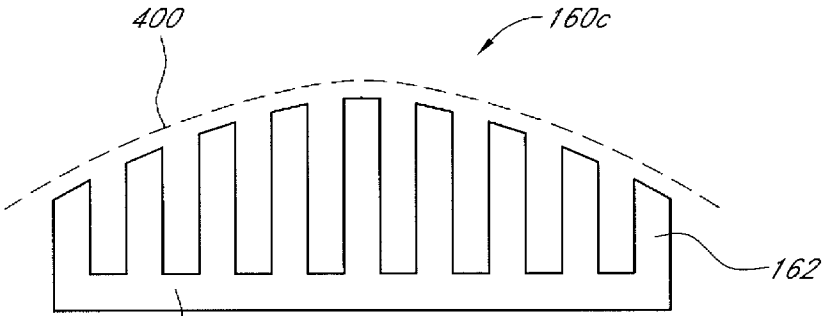
Figure 8A:
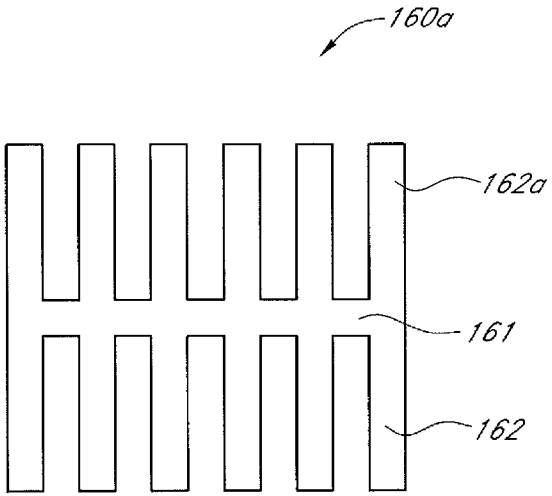

FIGS. 8A-8C illustrate front schematic views of other embodiments of the pocket forming device 160 shown in FIGS. 1-7. Components in these embodiment that are substantially similar to components of the embodiment shown in FIGS. 1A, 1B, 2 and 7 have been given the same reference number.

FIG. 8A illustrates an embodiment of a pocket forming device 160*a* that comprises a second plurality of elongated members 162*a* that function similarly to the plurality of elongated members 162 described above. The main difference in this embodiment is that the second plurality of elongated members 162*a* extends away from the elongated base 161 in a different direction than the first plurality of elongated members 162. In operation, the user of device 160*a* has flexibility to bend elongated members 162*a* in addition to bending elongated members 162 when forming the shape of a pocket 300 in an apron 100 (FIGS. 1A, 1B, 2, 7).

FIG. 8B illustrates an embodiment of a pocket forming device 160*b* wherein the angle of elongated members 162 relative to each other and/or elongated base 161 varies, to form a desired profile 400 of device 160*b*. FIG. 8C illustrates a pocket forming device 160*c*, wherein the length of elongated members 162 are varied relative to each other along the length of elongated base 161, to form a desired profile 400 of device 160*b*. Varying the configuration of elongated members 162 to form various profiles of device 160 can provide the user with different pocket shapes, when forming a pocket 300 with any of pocket-forming devices 160*a*, 160*b*, 160*c*.

Figure 9:
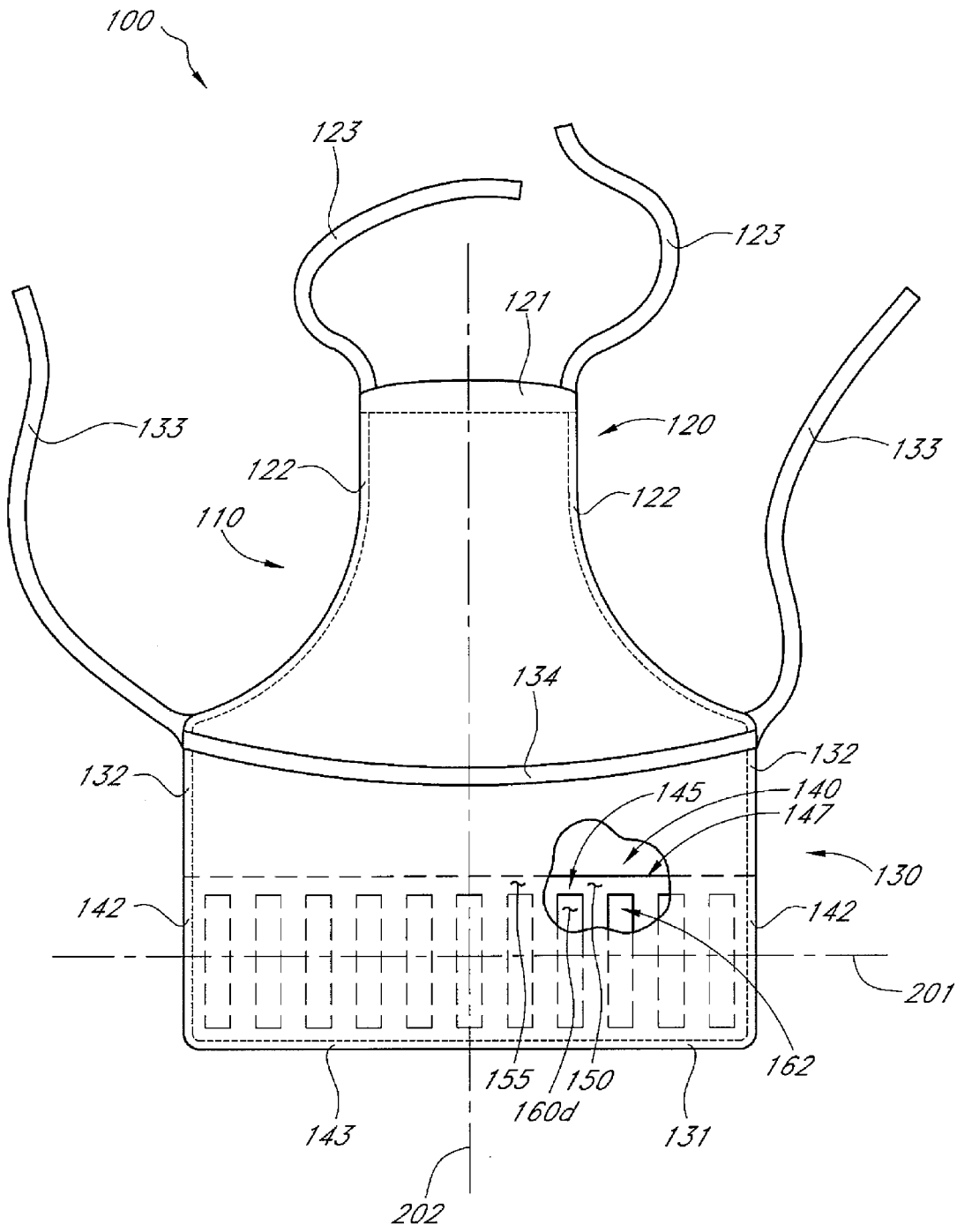
FIG. 9 is a front schematic view of an apron adapted to receive a pocket-forming device.

FIG. 9 illustrates an embodiment of an apron 100 with a pocket forming device 160*d* comprising a plurality of elongated members 162. Device 160*d* and the plurality of elongated members 162 function similarly to the various embodiments of the elongated members and pocket forming devices described further herein. The main difference in this embodiment is that the plurality of elongated members 162 are not connected to an elongated base 161, and are spaced apart from each other across a portion of a width of the apron. In some embodiments, elongated members 162 are not connected to each other. In a preferred embodiment, pocket forming device 160*d* comprises at least three elongated members 162, although a skilled artisan will understand that embodiments with greater than three elongated members 162 will provide increased control of the shape of a pocket in apron 100. In some embodiments, elongated members 162 can be connected to or held adjacent to apron 100 as described in the other embodiments herein. In some embodiments, elongated members 162 can be received by a plurality of pouches 145, wherein each pouch 145 can be sized and shaped to closely receive one member 162. In some embodiments, elongated members 162 can be held adjacent to a portion of apron 100 by forming a hem around each of elongated members 162.

Although this invention has been disclosed in the context of certain embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. An apron comprising:

a garment adapted to be worn as an apron, a portion of the garment including a pouch adapted to receive a device; and a device adapted to be received within the pouch of the garment, the device comprising an elongated base approximately 4 inches to 30 inches long, and at least three elongated members extending away from the base and having ends connected to the base at different positions along a length of the base, at least one of the elongated members being configured to be bent about an axis substantially parallel to a portion of the base;

wherein the device is adapted to reside within the pouch, and wherein the elongated members can be bent to cause the portion of the garment to form a pocket for catching debris.

2. The apron of claim 1, wherein the each elongated member is configured to be repeatedly moved between a bent position and an unbent position.

3. The apron of claim 1, wherein the each elongated member is stable when bent such that the pocket forms a stable shape.

4. The apron of claim 1, wherein the at least three elongated members comprises a first elongated member and a second elongated member of substantially the same size and/or shape.

5. The apron of claim 1, wherein the base is configured to be bent about an axis extending generally parallel to a length of the garment.

6. The apron of claim 1, wherein the at least three elongated members comprises a first elongated member positioned approximately adjacent to a second elongated member, wherein the first and second elongated members are configured to be bent toward and away from each other.

7. The apron of claim 1, wherein the pocket is formed in a lower portion of the garment.

8. The apron of claim 1, wherein the pouch is removable from the apron.

9. The apron of claim 1, wherein the pouch is configured to removably receive the device.

10. The apron of claim 1, wherein the pouch is configured to receive the device from a back side of the garment.

11. The apron of claim 1, wherein proximal portions of the elongated members are connected to the elongated base, the proximal portion of at least one of the elongated members extending approximately orthogonally away from the elongated base.

12. The apron of claim 1, wherein the elongated members are approximately evenly spaced along the length of the base.

13. The apron of claim 1, wherein proximal portions of the elongated members are connected to the elongated base, the elongated base being configured to be bent about an axis generally parallel to the proximal portion of one of the elongated members.

14. The apron of claim 1, wherein the elongated members and/or the elongated base comprises sheet metal.

15. The apron of claim 1, wherein the elongated base and the at least three elongated members form a substantially comb-like shape.

16. The apron of claim 1, wherein one of the elongated members is held adjacent to the garment with a hem at least partially surrounding said elongated member.

17. The apron of claim 1, wherein the elongated base is approximately 6 to 24 inches long.

* * * * *